US006503558B2

(12) United States Patent
Williamson

(10) Patent No.: US 6,503,558 B2
(45) Date of Patent: Jan. 7, 2003

(54) METHOD OF TEXTURING A FLUID SURFACE

(75) Inventor: John Williamson, Cutthorpe (GB)

(73) Assignee: Errut Product Limited, Derbyshire (GB)

( * ) Notice: Subject to any disclaimer, the term of this patent is extended or adjusted under 35 U.S.C. 154(b) by 189 days.

(21) Appl. No.: 09/367,840

(22) PCT Filed: Feb. 26, 1998

(86) PCT No.: PCT/GB98/00455

§ 371 (c)(1),
(2), (4) Date: Nov. 9, 1999

(87) PCT Pub. No.: WO98/38384

PCT Pub. Date: Sep. 3, 1998

(65) Prior Publication Data

US 2001/0038885 A1 Nov. 8, 2001

(30) Foreign Application Priority Data

Feb. 26, 1997 (GB) ..... 9703948

(51) Int. Cl.[7] ..... B05D 1/12

(52) U.S. Cl. ..... 427/180; 427/136; 427/202; 427/359; 427/403

(58) Field of Search ..... 427/136, 202, 427/204, 359, 405, 278, 180, 201; 118/112; 404/103, 112

(56) References Cited

U.S. PATENT DOCUMENTS

| | | | | |
|---|---|---|---|---|
| 1,533,085 A | * | 4/1925 | Arnett | |
| 1,736,413 A | * | 11/1929 | Lichtenberg | |
| 2,048,071 A | * | 7/1936 | Jacobson | |
| 4,142,815 A | * | 3/1979 | Mitchell | |
| 4,702,640 A | | 10/1987 | Allen | 404/75 |
| 4,917,533 A | * | 4/1990 | Wilson | |

FOREIGN PATENT DOCUMENTS

| | | | |
|---|---|---|---|
| EP | 180687 | * | 5/1986 |
| FR | 2 258 490 | | 8/1975 |
| GB | 1 506 421 | * | 4/1978 |
| WO | WO 97/07286 | | 2/1997 |

* cited by examiner

*Primary Examiner*—Fred J. Parker
(74) *Attorney, Agent, or Firm*—Fulbright & Jaworski LLP

(57) ABSTRACT

A device and method for association with a rotatable powered roller having an elongate cylindrical roll surface adapted to be moved over a surface of newly laid fluid and surrounding formwork, wherein the manner of association is such that the roller surface includes an elongate substantially cylindrical texturing portion and at least two guide portions, the guide portions being adapted to support the texturing portion at a required level with respect to the fluid surface in a manner to ensure partial embedding of texturing material distributed thereon, use thereof in texturing a fluid surface, method for texturing a fluid surface and a fluid surface obtained thereby.

11 Claims, 6 Drawing Sheets

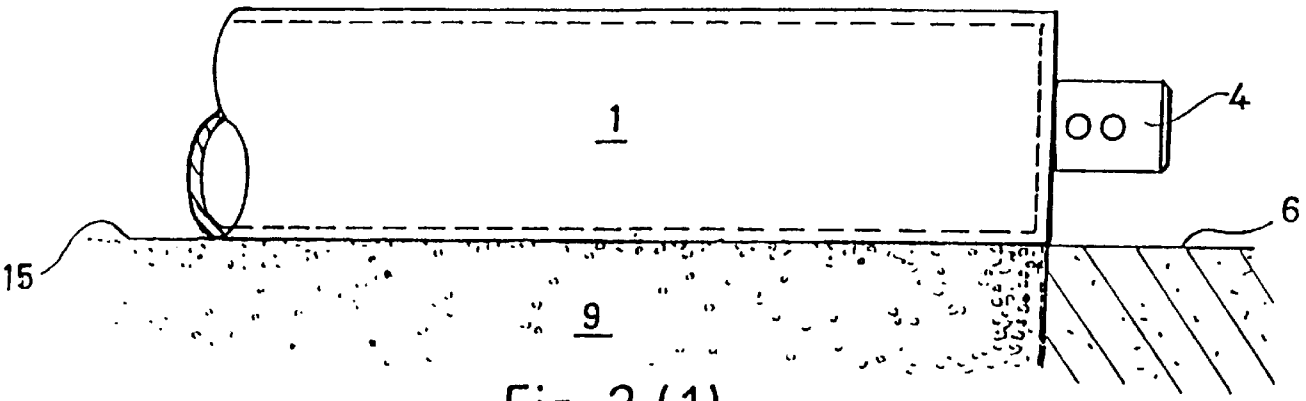
Fig. 2 (1)
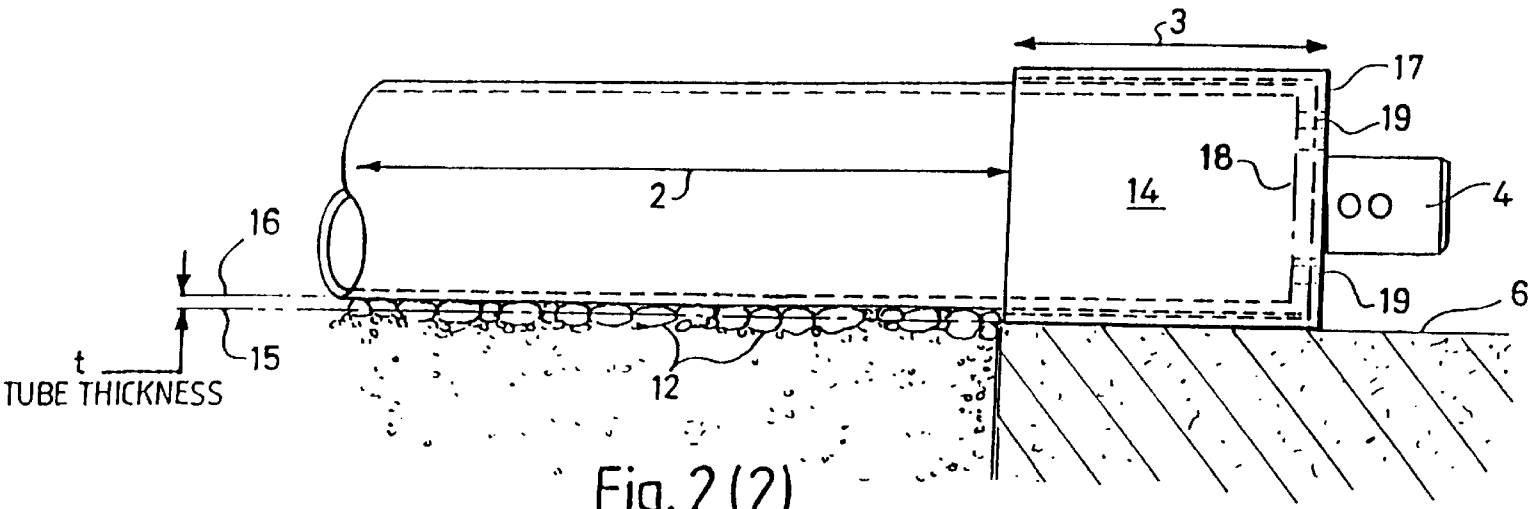
Fig. 2 (2)

40
39
9
32
30
31
35
33
36
34
37
38

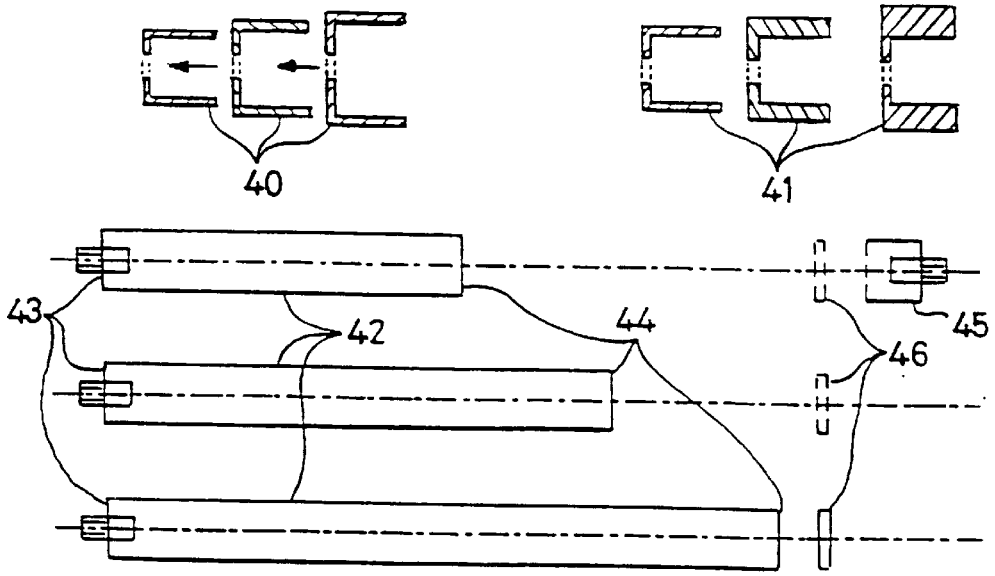
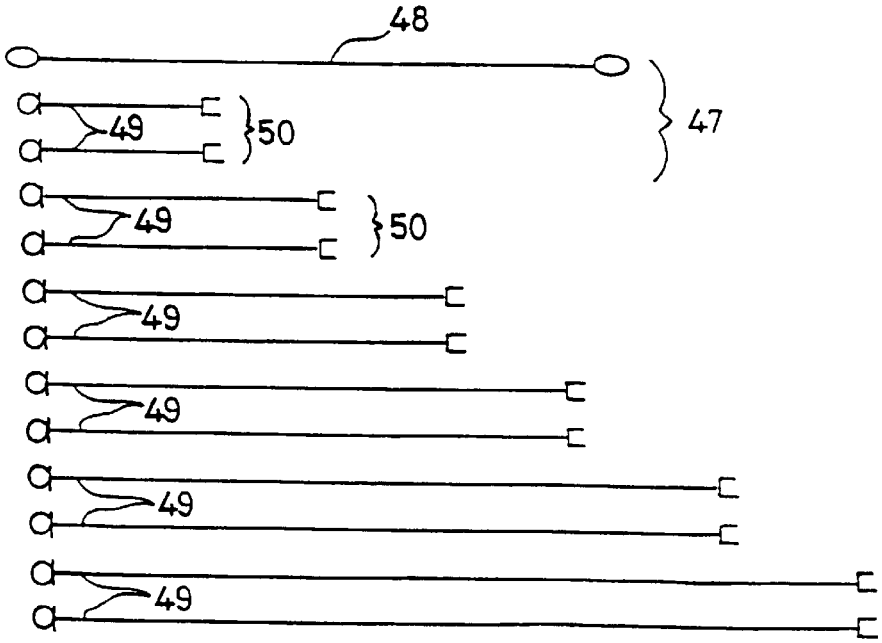
Fig. 6

METHOD OF TEXTURING A FLUID SURFACE

FIELD OF THE INVENTION

The present invention relates to a fluid surface texturing device, apparatus incorporating the same and a kit of parts, the use thereof in texturing a fluid surface and a process for texturing a fluid surface.

BACKGROUND OF THE INVENTION

Concrete has been used for many years to provide the wearing surface on highways. The popularity of the technique varies from country to country, and even within countries, for example between UK Highway Authorities, for the reasons given below.

Concrete is perhaps the most durable, and easily repaired of all materials for highways etc., but there are three interrelated drawbacks:

1. The surface's natural smoothness requires texturing for increased friction, and water drainage for the avoidance of skidding and "aquaplaning" when wet;

2. This "texturing" is usually carried out by a stiff brushing or raking as the concrete sets, which is prone to failure, since all texture surface is lost if there is rain at any time in the first 10 hours or so, of the setting process, or by cutting with diamond-tipped rotary blades which is extremely costly and justified only for retexturing runways for example, and leads to excessive, unpleasant audible noise emission as a driving surface;

3 Texturing produced by these methods rapidly wears under traffic, particularly so in areas where high friction is most needed, at corners and, junctions and the like, hence this is not a long term solution.

Asphalt finishes are less durable and need great care to repair properly, but the random surface pattern of particle size, position and gap widths of the surface layer of aggregate, provides a much quieter driving surface, greater friction naturally, and channels for surface water to occupy if not excessive, and to drain in heavy falls.

As a compromise, many roads are laid with a concrete substructure, and an Asphalt topping.

Much research has gone into trying to get concrete surfaces to imitate the performance of asphalt, resulting in the recent successful trials on UK motorways, of so-called "whisper" concrete. A special, aggregate rich surface layer is laid, but the top few millimeters of concrete are given a set-inhibitor, so that the concrete can be removed, this exposing the tips of the aggregate whilst leaving it partially embedded. This apparently provides a dramatic improvement in the required properties.

Unfortunately this chemical technique requires specialised equipment and trained operatives, and due attention to timing, dispersal of inhibitor, removal of the surface cement binder etc. For this reason the application is limited by cost and convenience.

There is therefore a need for a cost effective and convenient apparatus and method for producing a similar result to that of the chemical technique, and in a wide variety of applications, from footpaths, to motorways; for ornamental addition to concrete surfaces, or for discouraging pedestrians from walking in unsafe locations such as roundabout centres and the like.

Moreover there is a need for an apparatus and method for texturing concrete surfaces with acceptable surface flattener and levelness. A standard test method for determining surface flatness and levelness is given in astmE 1155-87. In particular there is a need for an apparatus and method which is self-regulating in terms of surface flatness and levelness produced for a textured surface, for high quality, efficient and reproduceable operation.

We have now surprisingly found a cost effective and convenient apparatus and method for texturing a concrete surface by mechanical means to produce a similar result to that of the chemical technique.

SUMMARY OF THE INVENTION

In its broadest aspect there is provided according to the present invention a device for association with a rotatable powered roller having an elongate cylindrical roll surface adapted to be moved over a surface of newly laid fluid and surrounding formwork, wherein the manner of association is such that the roller surface comprises an elongate substantially cylindrical texturing portion and at least two guide portions, the guide portions being adapted to support the texturing portion at a required level with respect to the fluid surface in manner to ensure partial embedding of texturing material distributed thereon.

Reference herein to formwork is to any vertical surround as necessary in the art to provide a boundary for casting a setable fluid, and includes an edge, cutaway or section of existing surface which is to be infilled or repaired.

Reference herein to a fluid is to any setting, curing or solidifiable fluid commonly used in the construction of load bearing surfaces such as footpaths, roads and the like. In particular, the fluids may include concrete and mixtures thereof with other construction materials.

Reference herein to texturing is to incorporation of a solid aggregate for the purpose of inducing a friction, drainage, decorative or ornamental, obstructive, guiding or marking surface and the like.

The aggregate material as hereinbefore defined may be any solid particulate or shaped object. The material may be comprised of any desired wearing, friction inducing, decorative, obstructive or non-obstructive material such as stone or gravel chippings which may be natural or coloured, depending on the effect required, glass fragments, ground glass, concrete or other composite blocks or formed objects and the like. The aggregate material may be of substantially uniform size or may be of a size distribution selected for graded or random texturing.

A device as hereinbefore defined may be integral or non-integral with a powered roller as hereinbefore defined. A non-integral device may be adapted to engage with or to be attached to the roller. The device may be of fixed or variable nature, or may be one of a plurality of superimposable devices, whereby the required level of the texturing portion may be selected as desired. It will be appreciated that the required level may vary widely according to the desired purpose and function of texturing, but is generally determined to be in the range of 50 to 80% of the average dimension of the aggregate material to be employed. A desired level may therefore be in the range of 2 mm–200 mm.

For example the required level for providing friction or drainage to a surface may be in the range of 2 mm–10 mm, preferably 3 mm–8 mm, whereas the required level for the purpose of introducing a barrier or obstruction to discourage access by humans or vehicles maybe of the order of 10–200 mm, and the required level for introducing guiding or marking texturing, for example to provide a footpath direction strip for the blind or a visible direction marker to indicate or segregate the paths may be in the region of 5 mm–20 mm, for example 7 mm–15 mm.

In a first aspect of the invention a device comprises two substantially identical sleeves which may be fitted around the rolling surface at either end thereof, the sleeves being constructed of any rigid load bearing material and having a sleeve-wall thickness corresponding to the required level as hereinbefore defined. Preferably each sleeve includes a base of one end having an aperture to receive the supporting axis of the roller, and adapted to abut against the end of the roller thereby maintaining the sleeve in place. The sleeve may include additional projections, attachments and the like for the same purpose, and preferably being readily engaged or released by hand or by simple tool.

A plurality of sleeves may be provided of different internal and external diameters, whereby a required level of the texturing portion of the roller may be obtained by means of placing one or a plurality of sleeves one about the other at each end of the roller. Alternatively a set of sleeves may be of similar internal diameter and of different external diameters, whereby a pair of sleeves may be selected to provide the required level.

In a second embodiment a device comprises a pair of support carriageways adapted to ride on, or near the formwork, and having a vertical aperture or the like to receive the ends of the roller. A carriageway riding on the formwork may comprise a friction surface adapted to enable it to slide, whereas a carriageway riding near the formwork may comprise a wheel base or the like. Each support carriageway may comprise sections enabling the height thereof to be adapted, whereby the required level of the texturing portion of the roller may be obtained, or may comprise a stepped surface having apertures or attachments at different elevations. Alternatively a pair of support carriageways may be selected from pairs of different heights. Alternatively each carriageway may comprise an asymmetric continuous or polygonal sleeve or annulus adapted to be located about each end of the roller, and to be rotated such that the guide portion riding on or near the formwork is of the required distance from the roller axis, thereby providing the required level of the texturing portion.

A rotatable, powered roller as hereinbefore defined may be any roller known in the art, preferably for striking the surface of newly laid concrete by being moved over the surface with the roller surface in slipping contact with the fluid surface and with opposite ends of the roller maintained at the required level of the fluid surface, in order to produce a smooth finish to the surface of the fluid. The roller may be of any desired weight to give the desired compression, and the weight may be adapted from one surface to another or indeed from the first striking stage to the second texturing stage by known means. Preferred means includes introducing a medium such as fluid (water) via entry points in the ends or surface of the roller.

The roller may be part of, or incorporated in, a "paving train" comprising from its leading end, to its following end a moveable hopper to spread the fluid, diagonal or other spreaders to distribute the fluid and control any surcharge of fluid, pokers or other vibrators to remove air, the striking off roller, a second hopper to spread the aggregate material, and a second roller having a texturing portion as hereinbefore defined. This is of particular advantage in laying and texturing rapidly setting surfaces or in the interests of economy in remote areas or for extensive surface areas. A preferred roller includes the roller described in co-pending unpublished International patent application PCT/GB96/01997, the contents of which are incorporated herein by reference. The preferred roller is adapted to be removed from the remainder of the apparatus and dismantled, when not in use, into constituent, smaller parts, and to be re-assembled with use of only some of the constituent parts or with use of all of the parts together with additional parts, whereby the length of the roller may be adapted in convenient manner. The roller suitably comprises internal stressing means for applying longitudinal compression to the roller, between the ends of the roller, so as to reduce the tendency of the roller to sag or become permanently bowed. It is a particular advantage that the roller may be provided as a kit of parts whereby it may be used with enhanced accuracy and convenience on any dimension fluid surface.

A device according to the present invention for use with any such dismantleable roller may be in the form of a roller part of increased diameter which may be readily inserted at the ends of the roller, or may be in the form of a sleeve to be located around a roller part, in place of or together with additional roller parts as desired.

A device comprising a sleeve as hereinbefore defined for use with a conventional non-dismantleable roller may be hinged or resiliently deformable, in manner that it may be expanded about a line parallel to the axis thereof, to provide a lengthwise aperture sufficient to receive the roller, and may be contacted in manner that smooth rolling action is achieved.

A device according to the present invention may conveniently be constructed of any desired natural or synthetic material having the necessary load bearing and substantially resiliently or non-deformable properties, preferably from suitable polymer, metal or composite materials such as steel, aluminium, bronze, nylon, polythene and the like.

It will be appreciated that a device as hereinbefore defined may be readily and simply assembled, attached or associated with a roller in the course of preparing a fluid surface. Moreover the operation of the roller in association with the device requires the same skill and technique as required for operation of the roller itself.

In a further aspect of the invention there is provided a kit of parts comprising one or more devices as hereinbefore defined. Preferably a kit of parts comprises in addition a rotatable, powered roller which is adapted to be removed from the remainder of the apparatus and dismantled, when not used, into constituent, smaller parts as hereinbefore defined. It is a particular advantage that a variety or selection of devices adapted for different purposes may conveniently and compactly be provided in the form of a kit.

In a further aspect of the invention there is provided the use of a device or a kit as hereinbefore defined for texturing a fluid surface. Texturing may be for any desired purpose, such as to provide a friction, drainage, decorative or ornamental, barrier or obstruction, guide or marking surface and the like. Preferably a fluid surface is a surface of newly laid concrete for a highway, footpath or drive, or for a, optionally selective, road or footpath obstacle or obstruction such as a bollard or the like preventing vehicle, motorbike, cycle or pedestrian access, optionally for a vehicle or the like above a given weight or ground clearance. Alternatively texturing may be for the purpose of guiding or marking, for example aggregate material in the form of spheres may be laid in a strip along the length of a newly laid concrete footpath, to provide the familiar foot-sensitive guide for the blind, or in other form for the purpose of segregating or distinguishing distinct pathways and the like.

In a further aspect of the invention there is provided a method for texturing a fluid surface comprising:

distributing aggregate material over the fluid surface in random or predetermined manner;

at a predetermined time thereafter moving a rotatable, powered roller over the fluid surface having the aggregate material thereon, with a texturing portion of the roller surface at the required level above the fluid surface, in order to produce a textured finished surface of the fluid; and allowing the fluid to set, cure or otherwise solidify.

Preferably the method comprises:

providing a quantity of fluid within formwork; and moving a rotatable, powered roller over a surface of the newly laid fluid, with the roller surface in slipping contact with the fluid surface and with opposite ends of the roller maintained at the required level of the fluid surface by means of the formwork, in order to produce a smooth finish to the surface of the fluid; and at a predetermined time thereafter texturing the surface as hereinbefore defined.

The aggregate material may be applied by hand or may be distributed from a hopper or a reservoir located in association with the roller or mounted on the formwork whereby it may be distributed directly after preparing the smooth fluid surface, or directly prior to the texturing thereof.

The various stages of the process may be carried out at predetermined times whereby the fluid is prevented from setting prior to texturing thereof, or is allowed to set to a predetermined consistency prior to the texturing thereof. Preferably the concrete is laid and smooth finish applied, whereafter the concrete is allowed to set for up to three hours and aggregate material is applied and the surface textured as hereinbefore defined, whereafter the concrete solidifies in a further six hours or so. This would provide a suitable textured surface for a highway, having adequate embedding and retention of aggregate material.

The texturing may be achieved in one or more passes of the roller over the formwork, or with one or more devices, to gradually achieve the end result of texturing the surface and pressing the aggregate into the surface.

In a further aspect of the invention there is provided a textured fluid surface obtained by the method or with use of the device of the invention.

The invention is now described in non limiting manner with reference to the following figures wherein

BRIEF DESCRIPTION OF THE DRAWINGS

FIG. 2(1) shows one end of the roller of FIG. 1 without the device according to the invention.

FIG. 2(2) shows one end of the roller of FIG. 1 with the device according to the invention.

FIG. 5 shows generally alternative devices of the invention associated with the roller of FIG. 4.

FIG. 6 shows a kit comprising devices of the invention.

DETAILED DESCRIPTION OF THE PREFERRED EMBODIMENTS

Figure 1:
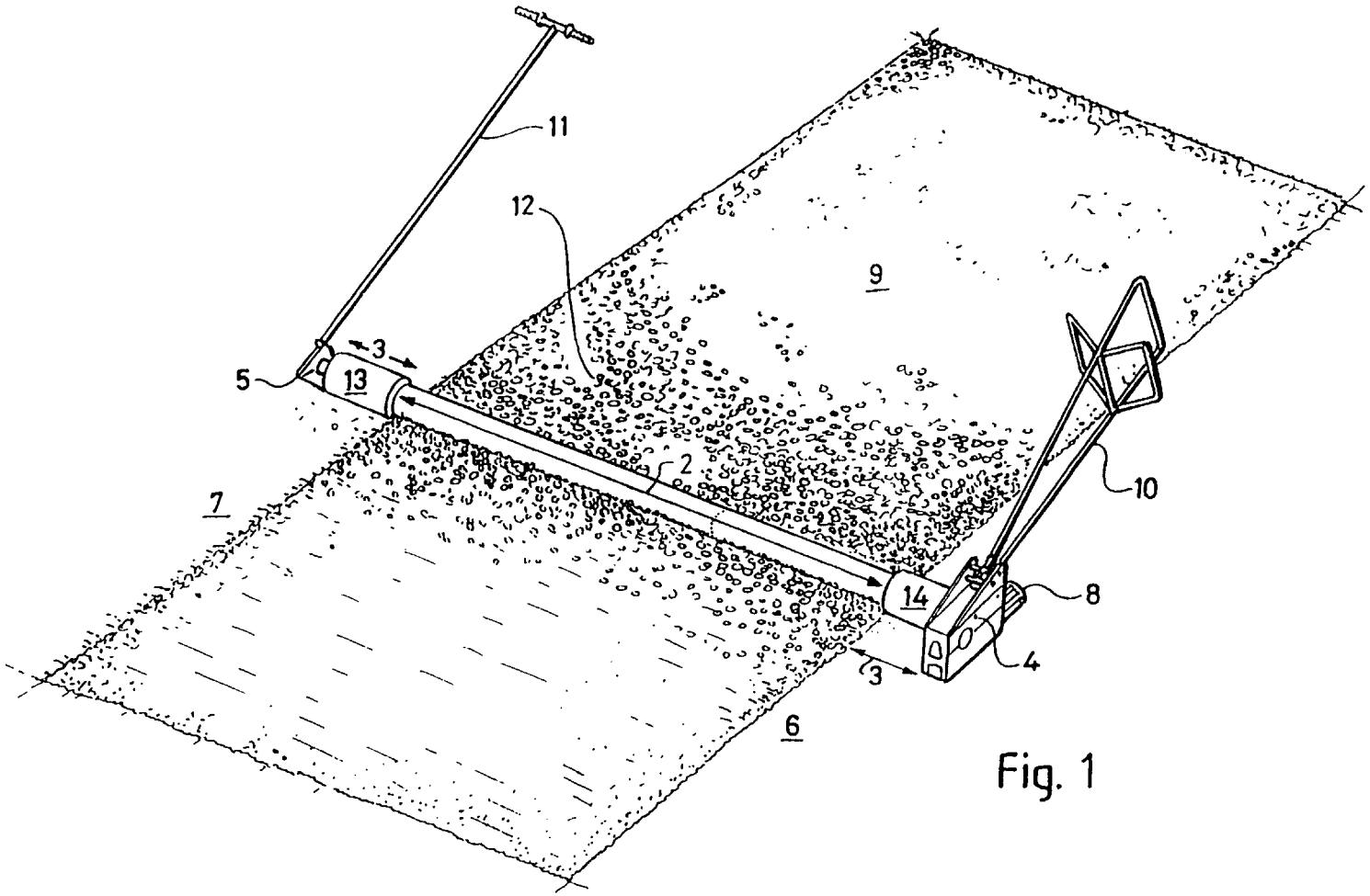
FIG. 1 represents a view of device according to the invention associated with a rotatable, powered roller in use.

In FIG. 1 is shown a rotatable, powered roller comprising roller (1) in component parts, comprising texturing and guide portions (2 and 3) supported on roller ends (4, 5) resting upon formwork (6, 7) in the form of a section of existing road surface. The roller (1) is powered by means of a mains powered electric motor (8). The roller is adapted to be drawn across a bed of still fluid concrete (9) by means of two handles (10 and 11). Alternatively the apparatus may comprises two winches (not shown) for drawing the apparatus over the concrete.

In FIG. 1 is shown aggregate material (12) distributed across the fluid surface. The guide portions (3) are associated with devices (13 and 14) comprising two sleeves located about the roller at the ends (4 and 5) thereof, whereby the guide portion (2) of the roller is maintained at the required level equal to the thickness of the sleeve walls above the fluid surface. The roller is shown being moved over the formwork so as to press the aggregate partially into the surface.

In FIG. 2 (1) is shown a roller end (4) at the level of the fluid surface (15), the end supports for the roller ends are not shown. The fluid surface is at the height of the formwork (6). In FIG. 2 (2) is shown the roller end of FIG. 2 (1) including a device (14) as shown in FIG. 1, in manner to provide a guide portion (3). The texturing portion (2) of the roller is thereby maintained at a level (16) equal to the sleeve thickness, t, above the fluid surface (15). The device includes an end section (17) which fits around the end of the roller, including an axial aperture (18) for the roller support and apertures (19) thereabout to secure the sleeve to the roller. Aggregate material (12) is shown partially embedded within the fluid surface (15), and partially compressed to textured surface level (16) by the texturing portion (2) of the roller.

In the Figure the roller is extended by guide portion (3) which projects outwardly across the formwork, whereby the required level may be achieved. In this case the roller (1) is dismantleable and an additional section is incorporated, which may be an end or middle section, in order to increase the length thereof.

Figure 3A:
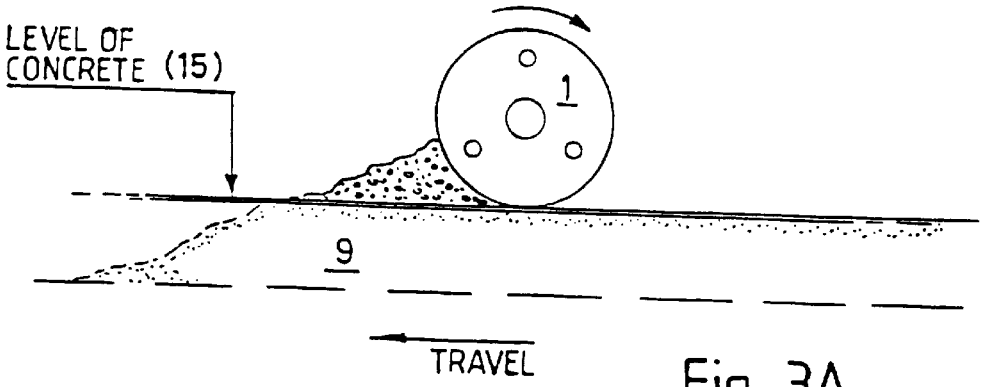
FIG. 3A shows an end view the roller and device of FIG. 2, in which the roller is being moved across a bed of newly laid fluid concrete.
Figure 3B:
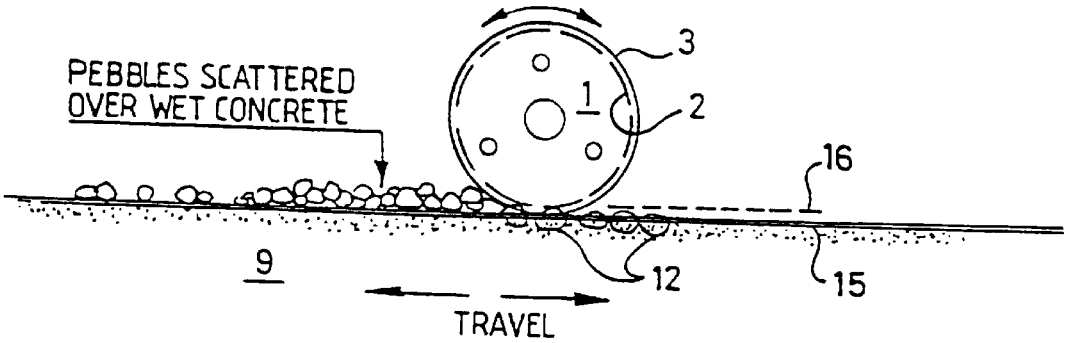
FIG. 3B shows an end view of the roller and device of FIG. 2, in which the device is embedding scattered pebbles into the fluid surface.
Figure 3C:
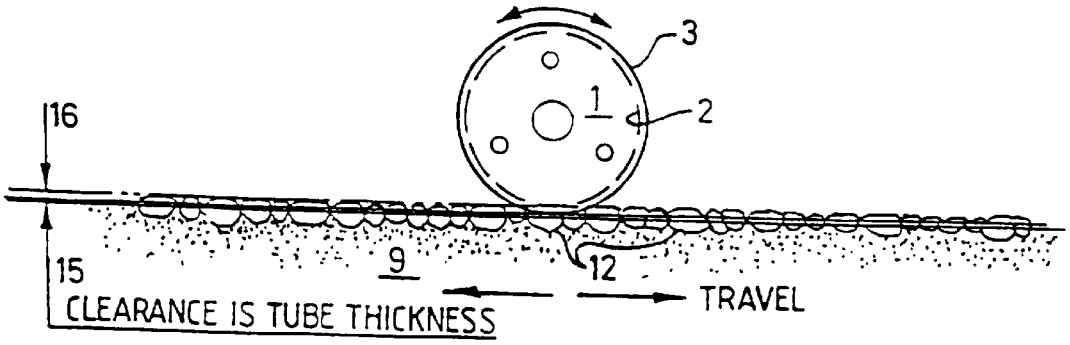
FIG. 3C shows an end view of the roller and device of FIG. 2, in which the device is making a second pass over the embedded pebbles shown in FIG. 3B.

In FIG. 3 is shown the process of the invention employing the device of FIGS. 1 and 2. In FIG. 3A, the roller is moved slowly across the bed of newly laid fluid concrete (9), with the surface of the roller in slipping contact with the fluid surface. A smooth finish (15) is obtained behind the roller. In FIG. 3B, texturing material (12) comprising pebbles have been scattered over the wet concrete and the roller incorporating the device comprising guide portions (3) is passed over the fluid surface, with the texturing portion of the roller (2) at the required level above the fluid surface (15), whereby the pebbles are partially embedded in the fluid surface, leaving a textured surface behind the roller. In FIG. 3C a second pass is made, optionally an overlayer (not shown) is provided in a subsequent stage to seal the aggregate material, without diminishing the textured effect thereof.

Figures 4, 4A, 4B, 4C, 4D:
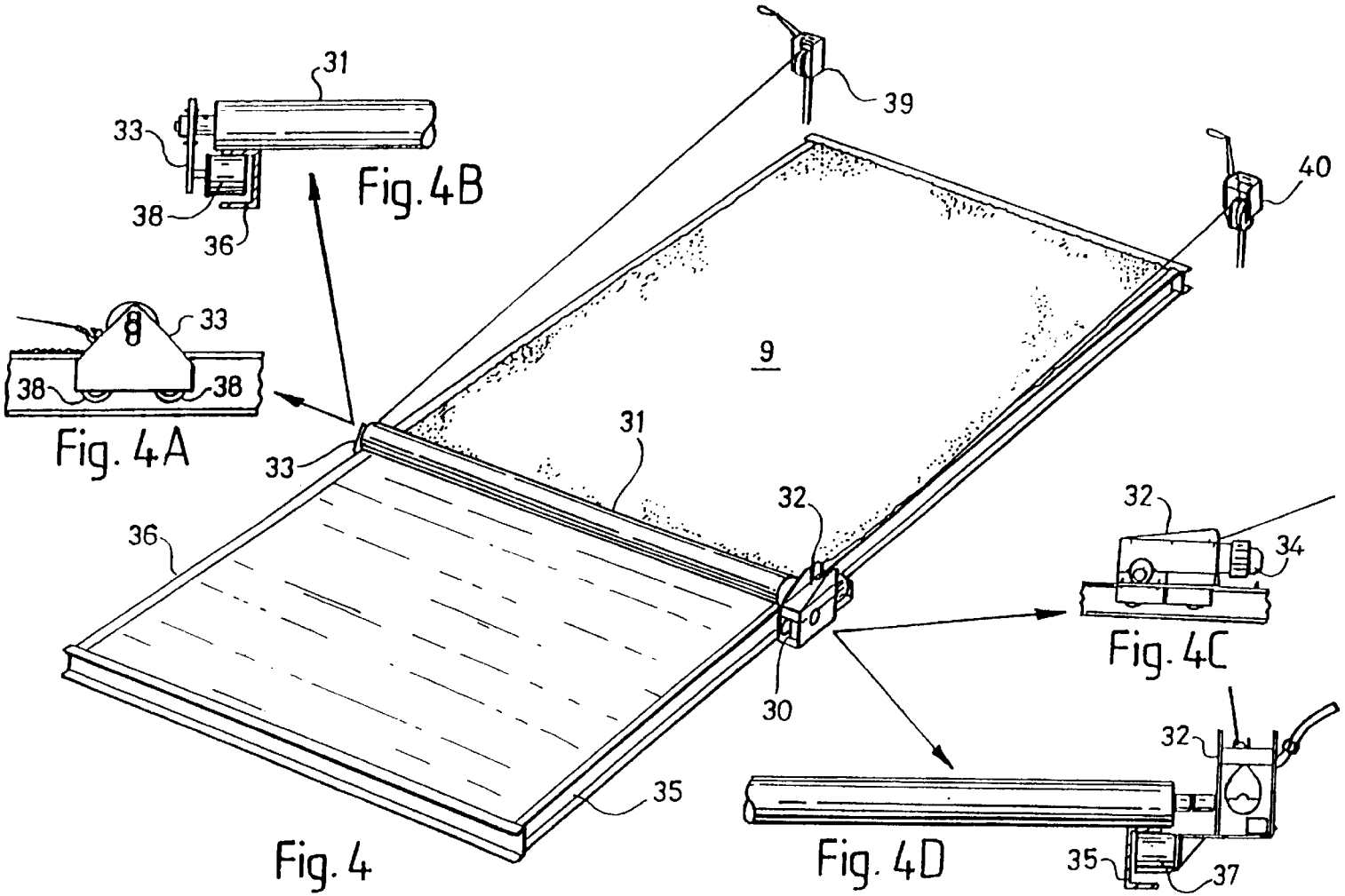
FIG. 4 represents a view of an alternative conventional powered roller in use.
FIG. 4A is a side view of the carriage and roller assembly of the powered roller of FIG. 4.
FIG. 4B is an end view of one end of the powered roller of FIG. 4, showing the positioning of a roller within a U-Section beam.
FIG. 4C is a sectional view of the powered roller of FIG. 4, showing the position of the motor with respect to the carriage.
FIG. 4D is a side view of one end of of the powered roller described in FIG. 4, showing the roller end portion in conventional (not-powered) form.
Figure 5A:
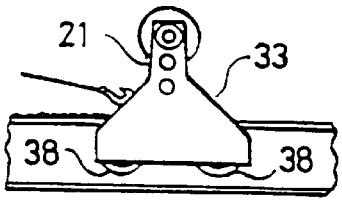
FIG. 5A shows an end view of an embodiment of the inventive device having discreet roller location apertures.
Figure 5B:
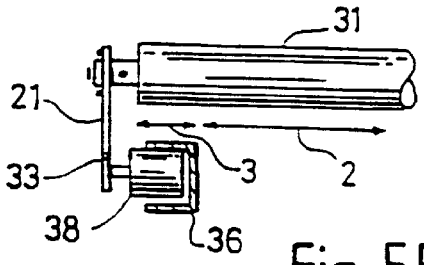
FIG. 5B shows a side elevation view of an embodiment of the inventive device having discreet roller location apertures.
Figure 5C:
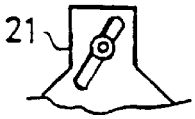
FIG. 5C shows an end view of an embodiment of the inventive device having a pressure/notch fitting secured to a diagonal slot aperture for securing the roller.
Figure 5D:
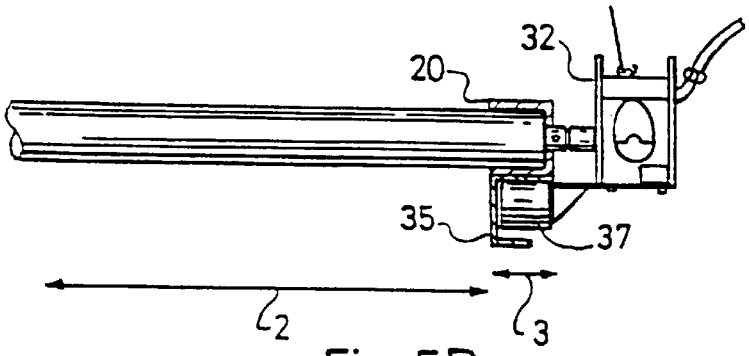
FIG. 5D is a side elevation view of the carriageway incorporating the motor of FIG. 4C in combination with a sleeve.
Figure 5E:
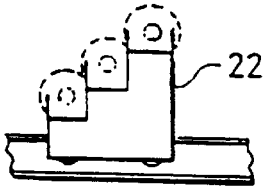
FIG. 5E shows an alternative embodiment of the invention in which a carriageway includes a wheeled guide portion with variable positioning.
Figure 5F:
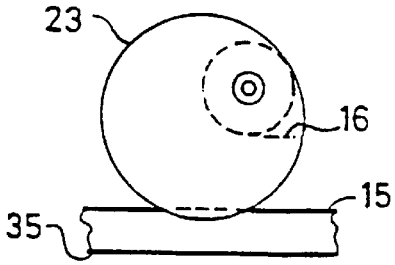
FIG. 5F shows an alternative embodiment of the invention in which the carriageway has a sliding guide portions adapted by variable rotation about an off-center axis to vary the elevation of the texturing portion of the roller above the fluid surface.
Figure 5G:
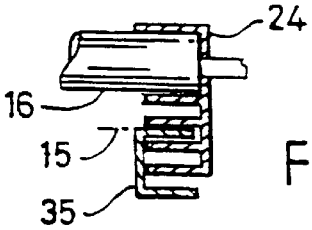
FIG. 5G shows an alternate embodiment of the invention in which the carriageway includes a series of notched recesses to vary the elevation of the texturing portion of the roller above the fluid surface.

FIG. 4 illustrates an alternative conventional apparatus wherein the roller (1) is rotatably mounted to two carriages (32 and 33), one having a roller powering motor (34). The formwork comprises two U section beams (35 and 36) on their sides. The roller ends rest upon the tops of the beams (35 and 36) whilst the carriages (32 and 33) have relatively small guide rollers (37 and 38) which engage undersides or two top flanges of the beams (35 and 36) so as to hold the roller (1) positively down, in contact with the formwork beams (35 and 36), thereby doing away with the need for handles. The apparatus is drawn over the concrete by two winches (39 and 40).

In FIG. 4D is shown in side elevation the roller end portion (4) in conventional form.

In FIG. 5 is shown various embodiments of the roller of FIG. 4 comprising devices according to the invention, in the form of sleeve (20) or carriageways (21 to 24), having a variety of variant height adjustment means. In FIGS. 5A and 5B are shown in end and side elevation the carriageway of FIG. 4, according to the present invention, having discrete roller location apertures. The location may alternatively be secured by-pressure or notch fit in a single elongate vertical or diagonal aperture, as shown in FIG. 5C. In FIG. 5D is shown in side elevation the corresponding carriageway incorporating the motor of FIG. 4, according to the invention, in combination with a sleeve (20). In FIG. 5E is shown an alternative carriageway (22) according to the invention having a wheeled guide portion with variable positioning. In FIGS. 5F and 5G are shown alternative carriageways (23) and (24) having sliding guide portions adapted by variable rotation about an off-centre axis or by a series of notched recesses locating with formwork (35) to vary the elevation of the texturing portion (16) above the fluid surface (15).

FIG. 6 shows a kit of parts according to the invention as hereinbefore defined, comprising interlocking sleeves of different aggregate wall thickness (40) or sleeves of different individual wall thickness (41), roller sections (42) of different lengths, suitably 2x, 3x and 4x unit lengths, where the unit length is dependant on the intended nature of the surface to be finished, suitably for concrete finishing, the unit length is 0.5–5.1 m, preferably 1 m or thereabouts. The sections (42) are shown each with an end plate (43) and a coupling member (44) (detail not shown). The kit also includes a dedicated end portion (45), and optional dedicated coupling members (46).

A tensioning member (47) is shown in its component parts, comprising cable (48) of 2x unit length and pairs of rods (49) each 0.5x, 1x, 1.5x, 2x, 2.5x and 3.5x unit length, or 14 rods (50) each of 0.5x unit length, or 7 rods (50) each of 1x unit length.

Further advantages of the invention will be apparent from the foregoing.

What is claimed is:

1. A method for texturing a fluid surface of a setting, curing or otherwise solidifiable fluid comprising concrete or a mixture thereof with other construction materials, said method comprising the steps of:

distributing aggregate material over the fluid surface before it is set, cured or otherwise solidified;

thereafter moving a rotatable, powered striking roller having an elongate cylindrical rolling surface of over the fluid surface having the aggregate material thereon, with an elongate substantially cylindrical texturing portion of the roller surface maintained at a level above the fluid surface, to ensure only partial embedding of the aggregate material thereinto, in order to produce a textured finished surface of the fluid wherein the texturing portion of the roller surface is maintained at the level above the fluid surface by attachment of at least two guide portions to the striking roller, the guide portions supporting the texturing portion of the roller surface at the level above the fluid surface; and allowing the fluid to set, cure or otherwise solidify.

2. The method as claimed in claim 1, further comprising the additional prior steps of:

laying a quantity of the fluid; and moving a rotatable, powered striking roller over a surface of the newly laid fluid, with the roller surface in slipping contact with the fluid surface and with opposite ends of the roller maintained at the required level of the fluid surface in order to produce a smooth finish to the surface of the fluid.

3. The method as claimed in claim 2, wherein the same striking roller is used to produce a smooth finish to the surface of the newly laid fluid and to produce a textured finish to the surface of the smoothed fluid, the roller being adapted from the smoothing to the texturing stage by provision of the guide portions.

4. The method as claimed in claim 3, wherein the roller is further adapted from the first smoothing stage to the second texturing stage by adapting its weight by introducing a medium by entry points in an end or surface of the roller.

5. The method as claimed in claim 1, further comprising the step of fitting guide portions to support the texturing portion at the level above the fluid surface comprising two substantially identical sleeves around the rolling surface of the roller at both ends thereof, the sleeves being constructed of a rigid load bearing material and having a sleeve wall thickness corresponding to the level above the fluid surface.

6. The method as claimed in claim 1, further comprising the step of fitting guide portions to support the texturing portion at the level above the fluid surface comprising dismantleable roller end portions of greater external diameter than the body of the roller which are inserted at the ends thereof.

7. The method as claimed in claim 1, wherein the fluid is first laid within a form work, and wherein guide portions to support the texturing portion at the level above the fluid surface are attached comprising a pair of support carriageways adapted to ride on or near the formwork and provided with a vertical aperture in which the ends of the roller are received.

8. The method as claimed in claim 1, wherein aggregate material is selected from the group consisting of solid particulate shaped objects of wearing, friction inducing, decorative, obstructive and non-obstructive material.

9. The method as claimed in claim 1, wherein the striking and texturing of the fluid surface is carried out at different times whereby the fluid is prevented from setting prior to texturing thereof, or is allowed to set prior to texturing thereof.

10. The method as claimed in claim 9, wherein the fluid is concrete, the concrete is laid and a smooth finish applied, the concrete is allowed to set for up to 3 hours, aggregate material is applied and the surface textured, and the concrete is allowed to set.

11. A method in accordance with claim 1, wherein the texturing is achieved in several passes of the roller to achieve the end result of texturing the surface and pressing the aggregate into the surface.

* * * * *

UNITED STATES PATENT AND TRADEMARK OFFICE

CERTIFICATE OF CORRECTION

PATENT NO. : 6,503,558 B2
DATED : January 7, 2003
INVENTOR(S) : John Williamson

It is certified that error appears in the above-identified patent and that said Letters Patent is hereby corrected as shown below:

Title page,
Item [73], Assignee, please change "Errut Product Limited" to -- Errut Products Limited --.

Signed and Sealed this

Ninth Day of December, 2003

JAMES E. ROGAN
*Director of the United States Patent and Trademark Office*